US005809796A

United States Patent [19]

Zakryk

[11] Patent Number: 5,809,796

[45] **Date of Patent: *Sep. 22, 1998**

[54] SELF REGULATING POOL HEATER UNIT

[76] Inventor: John M. Zakryk, 5961 SW. 19th St., Plantation, Fla. 33317

[ * ] Notice: The term of this patent shall not extend beyond the expiration date of Pat. No. 5,471,851.

[21] Appl. No.: 529,083

[22] Filed: Sep. 15, 1995

Related U.S. Application Data

[63] Continuation-in-part of Ser. No. 212,816, Mar. 15, 1994, Pat. No. 5,471,851.

[51] Int. Cl.[6] ..... F25B 27/00

[52] U.S. Cl. ..... 62/238.6; 62/231; 62/127; 62/129; 4/493

[58] Field of Search ..... 62/161, 163, 238.6, 62/238.4, 238.7, 125, 126, 127, 231, 129, 157; 237/2 B; 165/47; 4/493, 509

[56] References Cited

U.S. PATENT DOCUMENTS

| | | | |
|---|---|---|---|
| 3,976,123 | 8/1976 | Davies | 62/238.6 X |
| 4,653,287 | 3/1987 | Martin, Jr. | 237/2 B X |
| 4,718,248 | 1/1988 | Fisher | 62/238.7 |
| 4,907,418 | 3/1990 | DeFazio | 62/238.6 |
| 5,184,472 | 2/1993 | Guilbault et al. | 62/238.7 X |
| 5,313,874 | 5/1994 | Lackstrom | 62/238.4 X |
| 5,415,221 | 5/1995 | Zakryk | 165/47 X |
| 5,471,851 | 12/1995 | Zakryk | 62/238.6 |

*Primary Examiner*—Harry B. Tanner
*Attorney, Agent, or Firm*—Malloy & Malloy,P.A.

[57] ABSTRACT

To be used with a pool assembly of the type including a swimming pool, and a pool pump, a self regulating pool heater unit having a refrigeration unit structured and disposed to emit heat in order to heat a quantity of water cycled therethrough by the pool pump. Further, a power source is included and connected to the refrigeration unit, and to the pool pump through a timer. The timer has an on mode which sets a predetermined time period during which the power supplied by the power source flows therethrough to the pool pump so that it will function, and an off mode wherein no power flows through the timer to the pool pump. Additionally, an automatic timer bypass is included and connected in line between the power source and the pool pump. The automatic timer bypass is switchable between a bypass position and a normal position, the bypass position being defined by power flowing through the automatic timer bypass so as to bypass the timer, if it is not in the on mode, thereby ensuring that power flows to the pool pump regardless of the mode of the timer. Conversely, the normal position of the automatic timer bypass allows power to flow to the pump only through the timer. Further, the unit is structured to indicate when any of a number of defined hazardous operating conditions are present and prevent operation if the refrigeration unit.

25 Claims, 2 Drawing Sheets

SELF REGULATING POOL HEATER UNIT

The present invention is a continuation-in-part of the previously filed, now allowed patent application for "A SELF REGULATING SWIMMING POOL HEATER UNIT" filed Mar. 15, 1994 and assigned Ser. No. 08/212,816, U.S. Pat. No. 5,471,851.

BACKGROUND OF THE INVENTION

1. Field of the Invention

The present invention relates to a self regulating pool heater unit adapted to internally regulate its functioning and facilitate the identification and fixing of common unit malfunctions, while also providing for effective, selective heating of a pool assembly having either a swimming pool alone or a swimming pool and spa combination.

2. Description of the Related Art

Heater units utilized for heating water in swimming pools, spas, or swimming pool/spa combinations generally employ refrigerating units to heat the water. In particular, the heat used to heat the water is produced as a byproduct of the cooling cycle performed by the refrigeration unit's compressor. However, because it is a refrigeration unit that is being adapted to perform a heating function, many conditions regarding the operating environment of the unit must be precisely maintained in order to prevent serious system brake owns.

One important operating condition relates to the ambient air temperature when the unit is utilized. Because a pool heater is originally built as a refrigeration unit, and as such is primarily designed to be operated in warm conditions, if the ambient air temperature drops below an acceptable temperature range, freezing and compressor malfunction can result. Specifically, the ambient air is generally drawn into the refrigeration unit were it is cooled prior to expulsion. If the ambient air is already cold, the added cooling leads to the freezing conditions.

Conversely, the refrigeration unit needs the fluid flow therethrough to eliminate the heat being produced during its normal cooling cycle. If that heat is not being eliminated at a sufficient rate, either because of zero water flow or low water flow through the unit, difficulties can quickly arise.

Additionally, the refrigeration unit must generally contain a refrigerant gas if it is to operate effectively. If, however, insufficient quantities of the gas are present, the system will not heat the water, will waste power, and will unnecessarily wear the unit. On the other hand, because the gas is contained under pressure, if the gas pressure is to high, due either to internal or external conditions, a very dangerous and volatile state can be present, making continued operation of the unit unsafe.

To attempt to minimize many operating difficulties, as well as to conserve power, many known units utilize timers to regulate the use of the system by assuring the unit does not run continuously for extended periods of time. Currently in the art, pool heater and pump systems that utilize a timer will generally utilize external, wall mounted timers which must be adapted and connected to the heater for use. This adaptation can often be expensive and complex, as complicated, external power adaptations must often be made to direct power through the timer, and numerous relays and the like must be implemented into the refrigeration unit to regulate the system functions. Further, if any individual system regulation based on the operating conditions of the unit are to be performed, known regulating means merely shutdown the system and do not provide for any indication as to whether there is only a temporary or minor malfunction.

In addition to the many problems associated with the use of external timers, external timers are specifically structured to permit only a specified "on time" during which the pool pump operates the cycle water through the heater. As such, the timer itself must be disconnected and reconnected if an individual desires to heat their pool at a time different than that permitted by the timer. Further, in prior art systems that include pool/spa combinations, because the spa is generally structured to be operated on an independent bases, a separate pump and switch is often necessitated. As such, if a pool owner desires to have their swimming pool and spa heated as well, separate heating units are often employed, one for the spa individually and one for the overall system which is controlled by the timer. Such adaptation is obviously a great inconvenience to a user who must bear the expense of an additional refrigeration unit to provide for the added heating of the spa itself, and must specifically disengage the operation of the timer if they wish to heat the pool at a non-timer specified time. In fact, the expense of an additional pool heater just to heat a spa portion takes up so much space and is such an added expense, that some individuals turn to complex valve systems to direct both water from the pool and from the spa into the heater. Specifically, during normal heating operation the water flows out through the swimming pool portion of a pool/spa combination and is pumped through the heater unit for the return of heated water into the overall assembly through the spa. Conventionally, the spa is fitted with a waterfall portion so that the heated water may flow into the main pool portion and in turn heat the pool. Additionally, some of the heated water may also be diverted for direct introduction into the swimming pool portion.

When, however, an individual wishes to use solely the spa portion, a contained loop only between the spa and the heater is to be maintained. As such, a valve leading from the drain in the spa must be opened, and a valve leading from the drain in the pool must be closed such that the pool pump will appropriately draw the fluid only from the desired location. Such manual valve actuation, however, can also be a great inconvenience to a user, especially because the pump and heater is generally located in a remote, out of the way location, where it is concealed by bushes and shrubs.

Accordingly, it would be highly beneficial to have a heater unit which is internally wired in a cost effective and efficient manner so as to provide immediate and clear identification of minor shutdowns, which regulates the functioning of the system such that it will not overload or attempt to be operating when more serious malfunctions could result from continuous functioning, and which can be connected with the timer to provide for the regulation of the operating time, while still enabling immediate demand use of the unit when desired. Further, there is a need for such a device which is capable of permitting the use of a single refrigeration unit in a convenient manner without requiring a user to specifically deactivate a timer and/or actuate a number of valves to provide for the appropriate heating. The device of the present invention is designed specifically to address these needs in the art.

SUMMARY OF THE INVENTION

The present invention is directed towards a self regulating pool heater unit to be used with a pool assembly of the type including at least a swimming pool, but possibly a swimming pool and spa combination, and at least one pool pump. Included in the self regulating pool heater unit of the present invention is refrigeration unit. The refrigeration unit is specifically structured and disposed to emit heat so as to heat a quantity of fluid being cycled therethrough. Accordingly, disposed in fluid flow communication with the refrigeration unit is the pool pump. The pool pump is structured to draw the quantity of fluid from the pool assembly and cycle it through the refrigeration unit for heating thereof prior to reintroducing the quantity of fluid back into the pool assembly.

The unit of the present invention further includes a power source. The power source is structured and disposed to supply power to the refrigeration unit and the pool pump when necessary for operation. As such, connected between the power source and at least the pool pump is a timer. The timer is structured to be switched between an on mode and off mode during preset time intervals. In particular, the on mode provides for the power supplied by the power source to flow through the timer to the pool pump such that the pool pump will function to cycle the fluid through the refrigerator unit. Conversely, the off mode does ont allow any power to flow through the timer to the pool pump.

In addition to the timer, the pool heater unit of the present invention also includes an automatic timer bypass. The automatic timer bypass, which is connected in line between the power source and at least the pool pump, includes bypass switching means therein. the bypass switching means are specifically positionable between a bypass position and a normal position. The bypass position of the automatic timer bypass is defined by power flow therethrough so as to bypass the timer, if the timer is not already in its on mode. As such, the bypass position ensures that power will flow from the power source to at least the pool pump regardless of the mode of the timer. When, however, the switching means of the automatic timer bypass are disposed in their normal position, power is capable of flowing from the power source to at least the pool pump only through the timer, and accordingly, only when the timer is in its on mode will power flow from the power source to the pool pump.

Additionally, the self-regulating pool heater unit of the present invention includes mode switching means. The mode switching means are structured to switch the heater unit between a pool mode and a spa mode, and work in conjunction with autovalve positioning means. The autovalve positioning means are structured and disposed to automatically actuate a plurality of valves of the pool assembly to a desired setting. As such, when the mode switching means are moved to the spa mode, the valves are adjusted so as to cycle the heated fluid only through the spa of the pool assembly. Conversely, when the mode switching means are switched to the pool mode, the autovalve positioning means are structured to automatically actuate the plurality of valves in order to ensure that the quantity of fluid is cycled through the swimming pool of the pool assembly.

It is an object of the present invention to provide a self regulating pool heater unit which internally checks to ensure that a variety of operating conditions, which can affect the appropriate operation of the assembly, are within acceptable levels, and can thereby ensure that the unit does not function under dangerous or hazardous conditions that may result in more significant, permanent damage to the heater unit.

Also an object of the present invention is to provide a self-regulating pool heater unit structured to provide for facilitated pool heating, regardless of a mode of a conventional type timer unit included therewith.

Still anther object of the present invention is to provide a self regulating pool heater unit which incorporates an effective and efficient digital circuit design to ensure that appropriate operating conditions are in effect before the refrigeration unit functions continuously to heat water.

Another object of the present invention is to provide a self regulating pool heater unit which incorporates an effective and efficient digital circuit design to provide for the effective bypassing of a timer control which is utilized normally to control operation of the pool pump and/or heater unit.

Also an object of the present invention is to provide a self regulating pool heater unit which is structured to internally and automatically adjust a plurality of valves that control whether or not heated water is being cycled through only a spa or through both a pool and spa of a pool/spa combination.

An additional object of the present invention is to provide a self regulating pool heater unit which provides for immediate heating of a pool assembly when desired, without the need to disengage or reprogram a timer that is structured to normally control the operating time of the heater unit.

An object of the present invention is to provide a heater unit which can effectively and without extensive adaptation provide for immediate identification of commonly occurring malfunctions or hazardous operating conditions which can necessitate the shutdown of the heater unit until remedied.

A further object of the present invention is to provide a heater unit which, through the use of a number of internally controlled indicators, enables a user to independently identify a malfunction or hazardous operating condition without the need for a service call to identify only minor difficulties.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
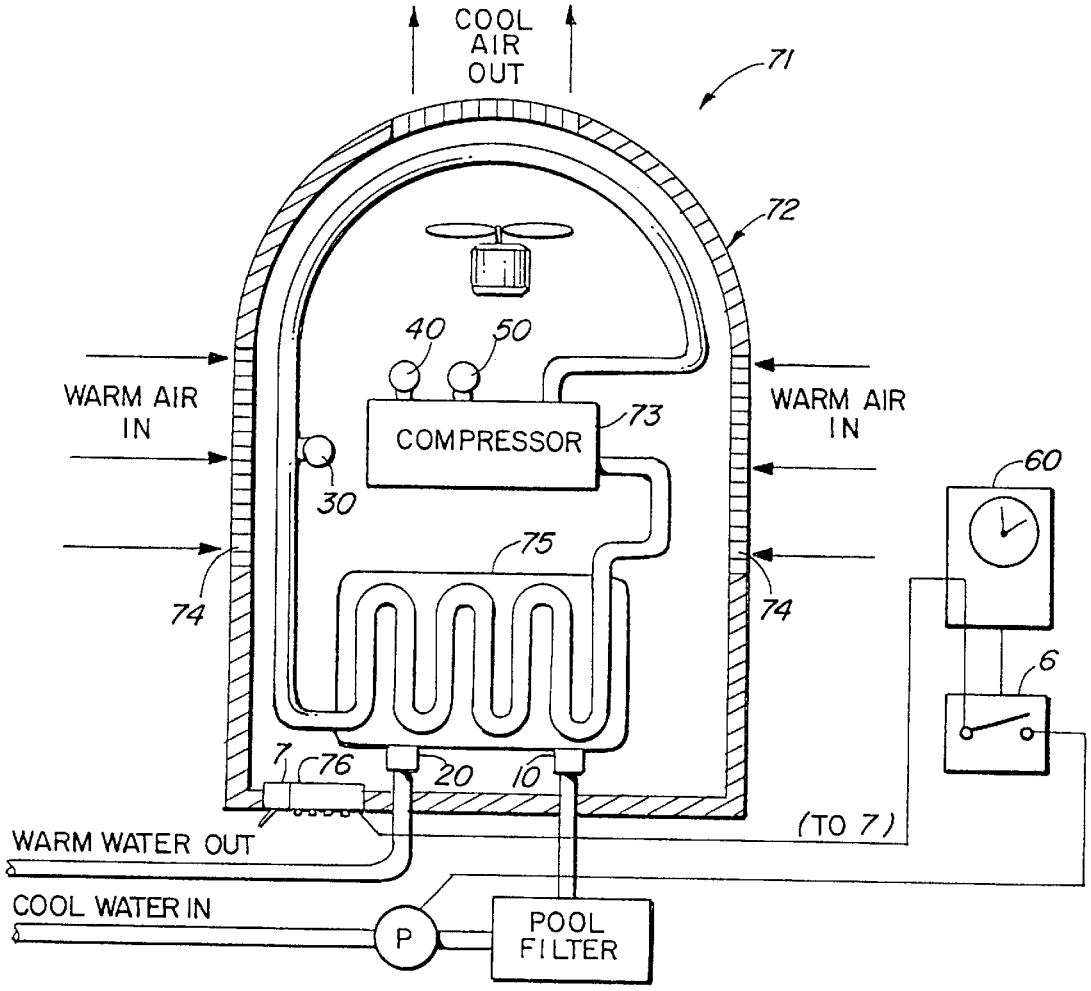
FIG. 1 is schematic, cross-sectional view of the self regulating pool heater unit of the present invention.

As detailed in the Figures, the present invention is directed towards a self regulating pool heater unit, generally indicated as 10. The self regulating pool heater unit is structured for use with a pool assembly, which can include a swimming pool only, a separate swimming pool and spa, or a pool/spa combination wherein water overflows from the spa into the swimming pool portion, so as to heat the water of the pool assembly. Further, the pool assembly is preferably of the type which includes at least one pool pump which effectively draws fluid from either the swimming pool, the spa, or both the pool and spa, for appropriate filtering and movement/cycling through the self regulating pool heater unit of the present invention.

Turning specifically to the self regulating pool heater unit 10 of the present invention, it includes primarily a refrigeration unit 71. The refrigeration unit 71 is much like a conventional central air conditioner refrigeration unit which normally produces heat as a byproduct of its cooling cycle. As such, the refrigeration unit 71 preferably includes a primary exterior housing 72 wherein a compressor 73 is contained. In use, a quantity of fluid is cycled through the refrigeration unit 71, and specifically through an internal, coiled flow through path 75 contained within the refrigeration unit 71, such that when the refrigeration unit emits a quantity of heat, the fluid being cycled through the refrigeration unit 71 is appropriately heated before being returned to the pool assembly.

As with most conventional refrigeration units, the refrigeration unit 71 of the present invention includes a quantity of refrigerant under pressure, such as freon, a plurality of air intakes 74 to draw in warm air over the compressor 73, and a cool air exhaust to evacuate the cool air formed during the cooling process. Accordingly, the actual heat producing function of the refrigeration unit is a conventional process that is generally known in the art.

Connected with the refrigeration unit 71 and the pool pump is a power source. This power source may be the conventional electrical supply of the facility where the pool is installed, and can even be an independent generator. Nevertheless, the power supply is structured to provide operating power to the refrigeration unit and to the pool pump, preferably via split connections so that the powering of the refrigeration unit is independent of the powering of the pool.

Further, the self regulating pool heater unit of the present invention includes a timer 60 connected in line between the power source and at least the one pool pump, although multiple pool pumps may be implemented. As with most conventional timers, the timer of the present invention includes an on mode and an off mode, each of which lasts for an extended, predetermined period of time based upon the time of day. More particularly, when the timer is in its on mode, the power supplied by the power source is able to flow through the timer and continue on to the pool pump so that the pool pump will function to draw water from the pool and cycle it through the refrigeration unit 71. Conversely, when the timer is in its off mode, no power is allowed to flow therethrough from the power source to the pool pump. Accordingly, a user can set an internal clock on the timer to correspond the time of day, and thereafter is able to set a predetermined on mode time period during which power flows directly through the timer to the pool pump, causing the pool pump to operate, and a predetermined off mode time period wherein no power can flow directly through the timer to the pool pump.

The self regulating pool heater unit of the present invention also includes an automatic timer bypass. The automatic timer bypass is also connected in line between the power source and the pool pump, and is preferably contained within the refrigeration unit itself. In the preferred embodiment, especially wherein the timer has been previously mounted on a wall surface adjacent the installation location of the refrigeration unit portion of the self regulating pool heater unit, the automatic timer bypass taps into the timer, such as through a series of wire connections. Generally, a conventional timer is structured to include a switch therein through which the power flows. When the timer's switch is in an opened position, the timer is said to be in its off mode, and when the switch is closed permitting power to flow therethrough, the timer is said to be in its on mode. As such, the tap to the automatic timer bypass is made in parallel, prior to the switch within the timer, thereby ensuring that the position of the timer switch does not matter with regard to the supply of power to the automatic timer bypass. The automatic timer bypass itself includes bypass switching means, to be described in greater detail subsequently, that are positionable between a bypass position and a normal position. When the bypass switching means are in the normal position, the power directed to the automatic timer bypass does not flow therethrough so as to directly provide power to the pool pump. When, however, the bypass switching means of the automatic timer bypass are switched to the bypass position, power is permitted to flow through the automatic timer bypass so as to bypass the timer, if it is not already in its on mode, and provide power to the pool pump such that water is drawn from the pool assembly for cycling through the refrigeration unit.

Preferably in addition to the automatic timer bypass, the self regulating pool heater unit of the present invention preferably includes a number of operating condition regulation devices that are also preferably built-in to the refrigeration unit itself. A first of the regulating devices includes a water thermostat 10. The water thermostat 10 is preferably connected at an inlet to the refrigeration unit so as to periodically sample the fluid entering the refrigeration unit and determine its temperature. Further, the water thermostat is structured to be adjustably set to detect a desired fluid temperature as determined by the user. In fact, this desired fluid temperature can be different depending upon whether pool heating or spa heating is desired by a user, and as such, the water thermostat of the present invention may be structured to accept the input of two different temperatures, which are to be maintained depending upon whether the self regulating pool heater unit is in a spa mode or pool mode.

Connected with the water thermostat is a first controller. This first controller has an engaged mode and a disengaged mode in which it is maintained depending upon the fluid temperature detected by the water thermostat. Specifically, the first controller is normally in maintained in its engaged mode when the fluid temperature detected by the water thermostat remains below the desired fluid temperature. Conversely, it is disposed in its disengaged mode while the fluid temperature detected by the water thermostat is at or above the desired fluid temperature.

In an alternative embodiment of the present invention, the water thermostat 10 is also connected with sampling means such that upon the automatic timer bypass being switched to its bypass position, power is directed to the pump only at periodic intervals. Accordingly, the pump is turned on for only a short period of time in order to permit the water thermostat to sample the water temperature. Only when the temperature of the fluid being cycled drops below the desired fluid temperature will power be maintained to the pool pump to continue its operation to cycle water through the refrigeration unit. That cycling, however, will continue only until the fluid being cycled reaches the desired fluid temperature or a predetermined value slightly above that temperature, after which the brief sampling continues. As such, when a user does not wish to have the pool pump, and therefore the self regulating pool heater unit, running somewhat continuously due to the predetermined time intervals set by the timer, the user is still able to easily and conveniently provide for immediate and effective heating without having to reset or adjust the timer, and without having the pool pump constantly running while the water is above the desired fluid temperature.

In addition to the water thermostat, a water flow detector 20 is also preferably included as one of the operating condition regulation devices of the present invention. The water flow detector 20, which is preferably positioned at an outlet of the refrigeration unit, is structured to determine a rate of a fluid flow through the refrigeration unit. Specifically, if the water pressure being cycled through the refrigeration unit by the pool pump drops, either as a result of a pool malfunction or a pump shut down, hazardous conditions associated with the refrigeration unit's inability to eliminate the heat produced may arise within the refrigeration unit. As a result, it is important to ensure that the rate of fluid flow does not drop below a predetermined minimum water flow rate while the refrigeration unit is still operating to produce heat.

To ensure that the refrigeration unit does not operate while insufficient water flows therethrough, a second controller is included and connected with the water flow detector. As with the first controller, the second controller includes an engaged and disengaged mode. The engaged mode is the normal mode that is in effect when the rate of fluid flow detected by the water flow detector is at or above the predetermined minimum water flow rate. Conversely, the disengaged mode is maintained while the rate of fluid flow detected is below the predetermined minimum water flow rate.

Similarly, an ambient temperature thermostat is also included and connected with a third controller. The ambient temperature thermostat is specifically structured and disposed to measure a temperature of the ambient air that is being drawn into the refrigeration unit, such as through the air inlets 74. Because most pool heater are installed in environments that tend to get cold in the winter time, it is important to determine the ambient temperature during operation. As previously mentioned, pool heaters are really converted refrigeration units, however when providing a heating function are usually called upon to operate when it is somewhat cold. Unfortunately, most refrigeration units are not ideally structured to operate at truly cold ambient conditions, such as below freezing. In use, if the ambient temperature drops below a certain minimum ambient air temperature, internal components of the refrigeration unit are subject to freezing or overloading that can lead to immediate malfunctions as well as to long term problems and damage. The ambient temperature thermostat is therefore structured to detect when the ambient temperature drops below what is determined to be an acceptable operating temperature. The third controller, to which the ambient temperature thermostat is connected includes an engaged mode and a disengaged mode. Normally, the third controller is in the engaged mode, so long as the air temperature detected by the ambient temperature thermostat is at or above the predetermined minimum ambient air temperature. Conversely, when the air temperature detected by the ambient temperature thermostat drops below the predetermined minimum ambient air temperature, the third controller moves to its disengaged mode.

Also contained within the refrigeration unit of the present invention is a refrigerant pressure sensor. Generally, most refrigeration units employed for heating or cooling purposes utilize a refrigerant gas, such as freon, to provide the cooling reaction that produces the heat byproduct. Because this refrigerant is generally maintained under high pressures, and can be volatile, it is important to determine if the refrigerant pressure is to high. Additionally, because the appropriate reaction does not occur when there is insufficient refrigerant present, it is often imperative to determine when the refrigerant pressure is low. Accordingly, the refrigerant pressure sensor of the present invention connected with a fourth and a fifth controller, and is structured to determine the pressure of the contained refrigerant gas.

Specifically the fourth controller, which has an engaged mode and a disengaged mode, is structured to be normally in the engaged mode so long as the refrigerant pressure detected by the refrigerant pressure sensor is at or above the predetermined minimum refrigerant pressure. Conversely, the fourth controller moves to its disengaged mode when the refrigerant pressure detected by the refrigerant pressure sensor drops below the predetermined minimum refrigerant pressure. Accordingly, the fourth controller sets the low end of the acceptable refrigerant pressure.

Similarly, the fifth controller includes an engaged mode and a disengaged mode. In the fifth controller, the normal, engaged mode is maintained while the refrigerant pressure detected by the refrigerant pressure sensor is at or below a predetermined maximum refrigerant pressure. In turn, when the refrigerant pressure rises above the predetermined maximum refrigerant pressure, thus indicating a hazardous condition, the fifth controller shifts to its disengaged mode.

The recited preferred controllers of the present invention may take on a number of different configurations, to be described hereafter; however, all of the controllers will be connected with the refrigeration unit such that only when all of the controllers are in there normal engaged orientation will the refrigeration unit operate. For example, if the water temperature as detected by the water thermostat is already above the desired fluid temperature as determined by the user, the first controller is in a disengaged mode and the refrigeration units will not operate to heat fluid that may be cycled therethrough. In particular, if the automatic timer bypass is in its normal position such that the timer controls the operation of the pump, the pump will continue to run, such as for filtration purposes, during the entire run time period. As the pool pump continues to run the fluid will continue to be cycled through the refrigeration unit, but because the temperature has already been satisfied the refrigeration unit will not be on so as to heat the fluid. Alternatively, when the automatic timer bypass is in the bypass position, the previously recited sampling means will direct a temporary run of the pump such that the water thermostat, as well as the various other condition detection sensors connected with the remaining controllers, are able to determine whether the appropriate operating conditions are present and therefore whether the refrigeration unit is permitted to operate thereby.

Additionally, so as to facilitate repair and maintenance, each of the controllers is preferably connected with an indicator light visibly positioned on an exterior of the refrigeration unit. The plurality of indicator lights will generally remain off when their corresponding controllers are in the engaged mode; however, the lights will correspondingly turn on when the appropriate controller moves to its disengaged mode. As a result, if the refrigeration unit is not operating, in many situations a user can merely check which indicator light is on and thereby determine the precise reason why the refrigeration unit is not operating. For example, the user is able to determine whether additional refrigerant gas is needed, thus permitting them to call a service technician and provide them with specific details of the problem, or the user can determine that the water flow rate is low, thus leading them to the likely conclusion that one of the valves of the pool assembly is improperly oriented.

Figure 2:
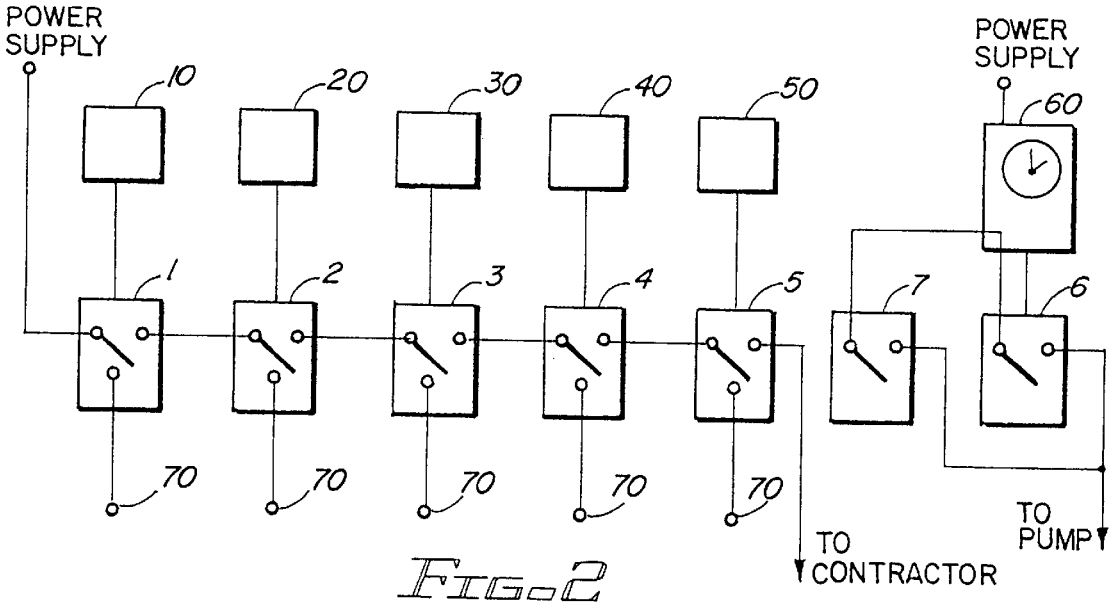
FIG. 2 is a schematic circuit diagram of an embodiment of the control circuit of the self regulating heater unit of the present invention.

In one embodiment of the present invention, as illustrated in FIG. 2, the plurality of the controllers all include single pole, double throw switches connected in series with one another between the power supply leading to the refrigeration unit and the main contactor of the refrigeration unit such that if any one of the switches is open the refrigeration unit will not operate. As such, the engaged position of the various contactors includes the corresponding switch being in a closed orientation so that power continues to flow therethrough, while the disengaged positioned of the controller includes the various switches in the open orientation. The orientation of these switches is naturally controlled by the regulating device to which it is connected, and in the preferred embodiment each of the switches includes a third wire extending therefrom to the indicator light. As such, when the switch is in its open position, power does not continue therethrough to the main contactor, however, power does get directed to the indicator light so as to appropriately illuminated it and indicate that some problem is present. Similarly, in this embodiment the bypass switching means of the automatic timer bypass also includes a single pole double throw switch that is connected in parallel with the switch of the timer and is preferably contained within the refrigeration unit itself.

Turning to specifically to pool assemblies that include a swimming pool and a spa, the self regulating pool heater 10 of the present invention also preferably includes mode switching means. The mode switching means, which are preferably disposed within the refrigeration unit itself, are structured to switch the self regulating pool heater unit between a pool mode and a spa mode, and are preferably connected with the automatic timer bypass. In use, when the mode switching means are disposed in the pool mode, the pool pump is activated only when the timer is in the on mode, or when the bypass switching means of the automatic timer bypass are in the bypass position. Conversely, when in the spa mode the pool pump will be activated regardless of the mode of the timer and regardless of the position of the bypass switching means of the automatic timer bypass. As such, only a number of predetermined conditions will result in the operation of the self regulating pool heater unit of the present invention. Specifically, in the preferred embodiment these predetermined conditions includes: (a) all of the controllers being in the engaged mode, and (b) (i) said mode switching means being in said spa mode, or (ii) said mode switching means being in said pool mode and said bypass switching means of said automatic timer bypass being in said bypass position, or (iii) said timer being in said on mode.

In a circumstance wherein both a pool and a spa are included, it is preferred to include and operate only a single refrigeration unit, thereby saving the initial expense in purchasing a second refrigeration unit and saving in the maintenance and operation costs associated with two refrigeration units. As such, a number of valves are generally included to appropriately direct water in and out of the refrigeration unit as directed by the pump. In this regard, multiple pumps may also effectively be utilized, and as such the connections previous recited as being direct towards the pool pump may be directed to all of the pool pumps included. Further, means to save power wherein only the pool pump or the spa pump operate at one time, depending upon the position of the mode switching means, may also be effectively and easily implemented.

Nevertheless, a primary inconvenience associated with the use of a single refrigeration unit with a pool/spa combination involves the manipulation of the various valves. Generally, fluid is drained from the swimming pool portion of the pool assembly through a first conduit, and water is drained from the spa portion of the pool assembly through a second conduit. In use, both of the first and second conduits lead to a first valve whereafter the fluid is directed into the refrigeration unit. However, when only the spa is being run it is desirous that all the water be drawn from the spa, and when the overall pool assembly is being heated it is desirous to draw all of the water through the pool drain. Similarly, a single fluid conduit generally leads out of the refrigeration unit and back into the overall pool assembly. In circumstances wherein the spa portion of the pool overflows in the main pool, it is only necessary to direct this main return conduit into the spa, and possibly some minor jets within the pool itself. When, however the pool and spa are completely separate yet another valve must be included in order to direct the water exiting the refrigeration unit appropriately into the pool or the spa, depending upon the location from which it was drawn. Accordingly, it is evident that a number of independent valves may be included, these valves being structured to be opened or closed as needed to properly direct fluid flow. As such it is often difficult and complicated to appropriately manipulate the various valves and connections that are included to eliminate the need for a second refrigeration unit. Further, this manual actuation is often inconvenienced by the fact that the valves are usually located in remote, out of the way locations that are inconvenient to access. As such, the preferred embodiment of the self regulating pool heater unit of the present invention also includes autovalve positioning means.

Specifically, each valve of the pool is fitted with a small servo type motor structured to manipulate the valve between each of its acceptable positions. In use, therefore, the autovalve positioning means are structured to automatically actuate the plurality of valves of the pool assembly in conjunction with the mode switching means such that when the mode switching means are moved to the spa mode the plurality of valves are actuated so as to cycle the quantity of fluid only through the spa of the pool assembly. Conversely, when the mode switching means are moved to their pool mode, the plurality of valves are automatically actuated so as to cycle the quantity of fluid through the swimming pool of the pool assembly, either directly or thorough an overflow at the spa. This therefore provides a great convenience to the user during their desired operation.

As previously recited, one embodiment of the self regulating pool heater unit of the present invention includes a plurality of single pole, double throw switches to provide the various controllers and the switching means of the automatic timer bypass. In this regard, similar switches may be easily incorporated for use with the mode switching means and the autovalve positioning means. Nevertheless, in preferred embodiment of the self regulating pool heater unit, and so as to substantially improve the efficiency and operating abilities thereof, a plurality of digital logic connections are included on a digital circuit board so as to achieve the various, necessary functions.

Figure 3:
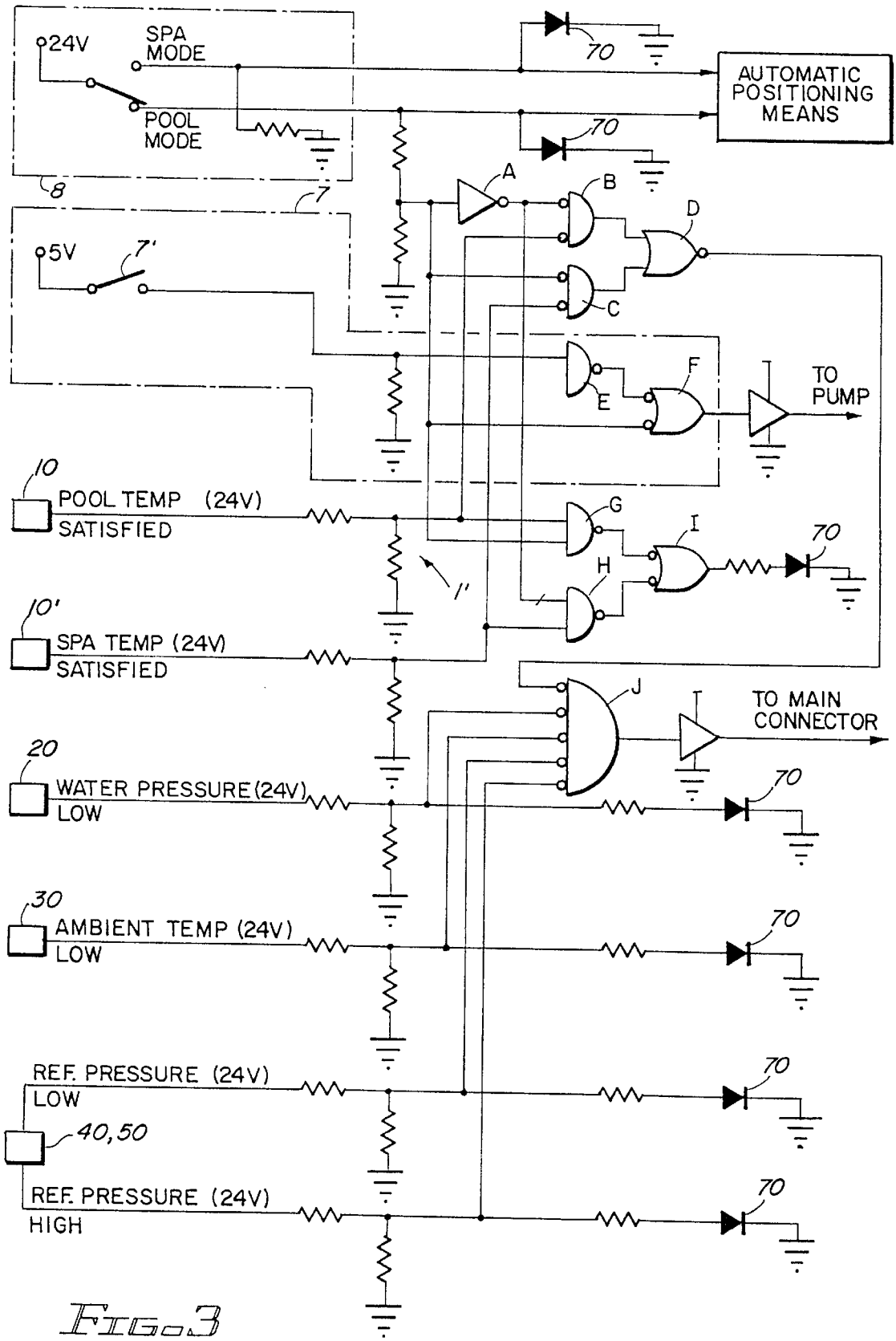
FIG. 3 is a schematic diagram of the digital circuit of the preferred embodiment of the present invention.

As illustrated in FIG. 3, the digital circuit of the present invention incorporates a plurality of digital logic gates structured to define the various controllers and switching means. Hereafter, a preferred embodiment of the digital control circuit implemented in the device of the present invention is described. Preferably, in this embodiment, control impulses utilized in the digital circuit and corresponding the various operating condition control mechanisms and the selection of a specific mode by the mode switching means 8 will be in the form of 24 volt impulse. With regard to the automatic timer bypass 7, the 24 volt impulse will preferably be stepped down to 5 volts, however, it is understood that these values may easily be adapted to meet the specific powering needs or requirements of the specific system.

Turning first to the mode switching means 8, it will preferably include a switch having a pool mode position and a spa mode position. As a result, the position of the switch directs the flow of the control impulse. As illustrated in the Figure, when the spa mode is selected by the mode switching means 8, the control impulse is directed to an indicator light 70, that may be appropriately labeled to indicate that the spa mode is active, and to the autovalve positioning means so as to signal that the various valves of the pool assembly should be oriented in a spa position. Conversely, when the mode switching means 8 are switched to the pool mode, the control impulse is directed to the autovalve positioning means to indicate that a pool position of the valve is necessary, to an indicator light 70, which a appropriately labeled to indicate that the pool mode is active, and to various logic gates connected in a manner to be described hereafter.

Turning next to the automatic timer bypass 7, the bypass switching means include a conventional switch 7' that can be opened to indicate the normal position or closed to indicate the bypass position. When the bypass switching means 7' is in the bypass position a control impulse is directed to an AND logic gate E. As illustrated in the Figure, the AND logic gate E is structure to detect a control impulse from the bypass switching means 7' and from the mode switching means 8, when it is in the pool mode. As such, only when both control impulses are detected by gate E will a control impulse exit gate E. Accordingly, if both control impulses are present, a control impulse exits logic gate E and is directed to logic gate F. As may be noted, logic gages E and F include NOT functions illustrated by bubbles either before or after the respective gates. In this case, however, since the NOT functions confront one another they cancel each other out and there is no effect. Conversely, however, logic gate F, which is an OR gate is structured to detect a control impulse either from the logic gage E, which indicates that both the bypass switching means 7' is in the bypass mode and that the mode switching means 8 is in the pool mode, or, as a result of the NOT function before the second input to logic gate F, that the mode switching means 8 is not in the pool mode and hence no control impulse is present. As such, if either of the two conditions are met at logic gate F, namely that the automatic timer bypass is in the bypass position and that the mode switching means are is the pool mode so that a control impulse is detected from logic gate E, or that the mode switching means 8 are not in the pool mode, and are hence in the spa mode, so that no control impulse is detected at the corresponding input by logic gate F, an impulse is directed out of logic gate F. Further, the control impulse directed out of logic gate F is stepped up and directed to a contactor connected between the power supply and the pump, and in parallel with the timer, so as to direct power to the pump and cause the pump to operate despite the orientation of the timer.

Turning to the second, third, fourth, and fifth controllers 2', 3', 4' and 5', portions of the digital control circuits are structured to initiate control impulses, as directed by the corresponding operating condition detection devices, which indicate that a corresponding hazardous or malfunction condition is present. For example, if the water flow rate detected by the water flow detector drops below the predetermined minimum water flow rate, a control impulse is initiated in the second controller 2'. From the second controller 2', the control impulse functions to illuminate an appropriate indicator light 70 connected with the second controller 2', and directs the control impulse to a primarily AND logic gage J. Similarly, if the ambient temperature detected by the ambient temperature thermostat drops below the predetermined minimum ambient air temperature, a control impulse is initiated in the third controller 3' so as to appropriately illuminate an indicator light 70 and direct the control impulse to the logic gate J. Finally, it either the refrigerant pressure, as determined by the refrigerant pressure sensor, drops below the predetermined minimum refrigerant pressure or rises above the predetermined maximum refrigerant pressure, a control impulse is correspondingly initiated in either the fourth or fifth controllers 4' or 5'. As such, that control impulse will illuminate the corresponding indicator light and will be directed to the logic gate J. It is noted that the manner of initiation of the control impulse can be any conventional method as is commonly employed with digital circuits. Further, as indicated in FIG. 3, all of the inputs to the AND logic gage J are preceded by a NOT function. Accordingly only if no control impulses are detected from any of the controllers 2', 3', 4' and 5' will a control impulse be directed out from logic gate J.

Logic gate J is further structured to detect a control impulse directed from logic gate D to be described hereafter. In particular, as illustrated in the schematic, a pool temperature thermostat 10 and as well as a spa temperature thermostat 10' may be included in the preferred embodiment, although it should be noted that a single thermostat may be adapted to perform both function selectively, and/or only one function may be necessary depending upon the features of the pool assembly. In this regard, if the pool temperature is satisfied (i.e. the fluid temperature detected by the pool water thermostat 10 is at or above the desired fluid temperature) a control impulse is initiated at the first controller 1'. Further, if the spa temperature is satisfied (i.e. the fluid temperature detected by the spa water thermostat 10' is at or above the desired fluid temperature) a control impulse is initiated at the first controller 1".

As is evident in the schematic, the control impulse initiated in the first controller 1' is directed to both logic gates G and B. Looking first to logic gate B, it is an AND logic gate and is structured to detect a control impulse initiated if the pool temperature is satisfied and a control impulse initiated if the mode switching mean 8 are in the pool mode. Specifically, it is seen that a NOT function precedes the input to logic gate B from the first controller 1', such that only if no control impulse is directed through the first controller 1', thus indicating that the pool temperature has not been satisfied, will the appropriate input condition from the first controller 1' be detected at logic gate B. Additionally, with regard to the control impulse directed from the mode switching means 8, it will first pass through a NOT function gate A which cancels out the NOT function preceding that input into logic gage B. Accordingly, a control impulse is directed out of the logic gate B to logic gate D only if the pool temperature is not satisfied and if the mode switching means 8 are in the pool mode.

Also preceding logic gate D is another AND logic gate C. As evidenced in the Figure, the AND logic gate C has one input to detect a control impulse from the mode switching means 8. As a result of the NOT function preceding this input, however, only if the mode switching means are not in the pool mode, and hence no control impulse is directed from the mode switching means 8, will the necessary input requirement for the first input into logic gate C be met. The second input into logic gate C relates to the temperature to the spa, and is also preceded by a NOT function. As such, if the spa temperature is not satisfied (i.e. no control impulse is initiated in the first controller 1"), and if the mode switching means 8 are not in the pool mode (i.e. they are in the spa mode), due to the NOT functions preceding each input into logic gate C, both input conditions in to logic gate C are satisfied and a control impulse is directed out of logic gate C into logic gate D.

As seen in the Figures, logic gate D is seen to be an OR logic gate. Accordingly, if a control impulse exits either logic gate B or logic gate C (i.e. because the mode switching means are in pool mode and the pool temperature is not satisfied, or the mode switching means are in the spa mode and the spa temperature is not satisfied), and is detected by logic gate D, a control impulse is directed out of logic gate D to logic gate J. Further, as seen in the Figure, corresponding NOT functions are positioned between logic gates D and J such that only if the temperature of the pool or spa, depending upon the mode selected, is not satisfied will the necessary control impulse input be detected by logic gate J to complete all of the input requirements of the AND logic gate J. Once all of those input conditions are satisfied at logic gate J, an appropriate control impulse exits logic gate J to the main contactor of the refrigeration unit and thereby permits the operation of the refrigeration unit.

Looking finally to logic gates G, H, and I, logic gate G is an AND logic gate whose input conditions are satisfied if both a control impulse indicating that the pool temperature is satisfied is detected from the first controller 1', and if a control impulse initiated as a result of the mode switching means 8 being in the pool mode is detected. If such is the case, a control impulse exits logic gate G and is directed through the OR logic gate I so as to illuminate an indicator light 70. Additionally, if the spa temperature is satisfied a control impulse is directed through the first controller 1" to an AND logic gate H, satisfying one of its required input conditions. Secondly, the logic gate H is connected with the mode switching means 8 through the NOT function gate A. Accordingly, if the mode switching means 8 are in the spa mode, such that no control impulse is directed to gate A, gate A initiates a reversal so that a control impulse is directed to logic gate H, satisfying the second of logic gate H's input requirements. As such, if the spa temperature is satisfied, and if the mode switching means are not in the pool mode (i.e. is in the spa mode), a control impulse is directed through the OR logic gate I so as to illuminate an indicator light 70.

It is noted that the previously described digital control circuit is merely the preferred embodiment at the time of application. It should be seen, however, that additional variations and additions thereto within the contemplated scope of the patent claims may also be implemented. Further, it is noted that the sampling means are not illustrated for clarity, however, a variety of the configurations of the sampling means may be included such as by interrupting the control impulse exiting logic gate F to the pump if the pool and spa temperatures are satisfied, and correlating a re-sampling at the determined time intervals thereafter.

While this invention has been shown and described in what is considered to be a practical and preferred embodiment, it is recognized that departures may be made within the spirit and scope of this invention which should, therefore, not be limited except as set forth in the claims which follow and within the doctrine of equivalents.

Now that the invention has been described,

What is claimed is:

1. To be used with a pool assembly of the type including at least one pool pump, and at least a swimming pool, a self regulating pool heater unit comprising:

a power source, a refrigeration unit, said refrigeration unit being structured and disposed to emit heat so as to heat a quantity of fluid being cycled therethrough by said pool pump, said power source being structured and disposed to supply power to said refrigeration unit and said pool pump, a timer connected between said power source and at least said pool pump, said timer including an on mode wherein the power supplied by said power source flows therethrough to said pool pump and accordingly said pool pump functions to cycle the fluid through said refrigeration unit, and an off mode wherein no power flows therethrough to said pool pump, an automatic timer bypass connected in line between said power source and at least said pool pump, said automatic timer bypass including bypass switching means connected thereto and positionable between a bypass position and a normal position, said bypass position of said bypass switching means of said automatic timer bypass being defined by said power flowing therethrough to bypass said timer if said timer is not in said on mode, thereby ensuring that said power flows from said power source to at least said pool pump regardless of the mode of said timer so as to cycle said fluid through said refrigeration unit for heating thereof, and said normal position of said bypass switching means of said automatic timer bypass being defined by said power being capable of flowing from said power source to at least said pool pump only through said timer, thereby ensuring that only when said timer is in said on mode will said power flow to said pool pump.

2. A self regulating pool heater unit as recited in claim 1 wherein said automatic timer bypass is disposed in said refrigeration unit.

3. A self regulating pool heater unit as recited in claim 1 wherein said automatic timer bypass includes a single pole double throw switch connected in parallel with said timer.

4. A self regulating pool heater unit as recited in claim 1 wherein said automatic timer includes a digital logic connection.

5. A self regulating pool heater unit as recited in claim 1 wherein said refrigeration unit further includes:

a water thermostat structured and disposed to periodically sample said quantity of fluid entering said refrigeration unit so as to determine its temperature, said water thermostat being adjustably set to detect a desired fluid temperature, a first controller connected with said water thermostat and including an engaged mode and a disengaged mode, said first controller being normally in said engaged mode while a fluid temperature detected by said water thermostat remains below said desired fluid temperature, and being in said disengaged mode while said fluid temperature detected by said water thermostat is at or above said desired fluid temperature, a water flow detector structured and disposed to determine a rate of fluid flow through said refrigeration unit, a second controller connected with said water flow detector and including an engaged mode and a disengaged mode, said second controller being normally in said engaged mode while the rate of fluid flow detected by said water flow detector is at or above a predetermined minimum water flow rate, and being in said disengaged mode while said rate of fluid flow detected by said water flow detector drops below said predetermined minimum water flow rate, an ambient temperature thermostat structured and disposed to measure a temperature of air being drawn into said refrigeration unit, a third controller connected with said ambient temperature thermostat and including an engaged mode and a disengaged mode, said third controller being normally in said engaged mode while the air temperature detected by said ambient temperature thermostat is at or above a predetermined minimum ambient air temperature, and being in said disengaged mode while said air temperature detected by said ambient temperature thermostat drops below said predetermined minimum ambient air temperature, a refrigerant pressure sensor structured and disposed to measure a pressure of a refrigerant contained for use by said refrigeration unit, a fourth controller connected with said refrigerant pressure sensor and including an engaged mode and a disengaged mode, said fourth controller being normally in said engaged mode while the refrigerant pressure detected by said refrigerant pressure sensor is at or above a predetermined minimum refrigerant pressure, and being in said disengaged mode while said refrigerant pressure detected by said refrigerant pressure sensor drops below said predetermined minimum refrigerant pressure, and a fifth controller connected with said refrigerant pressure sensor and including an engaged mode and a disengaged mode, said fifth controller being normally in said engaged mode while the refrigerant pressure detected by said refrigerant pressure sensor is at or below a predetermined maximum refrigerant pressure, and being in said disengaged mode when said refrigerant pressure detected by said refrigerant pressure sensor rises above said predetermined maximum refrigerant pressure, and said controllers being connected with said refrigeration unit such that only upon all of said controllers being in said normal engaged orientation will said refrigeration unit operate.

6. A self regulating pool heater unit as recited in claim 5 wherein each of said controllers is connected with a corresponding indicator light structured to remain off when a corresponding one of said controllers is in said engaged mode, and to turn on when said corresponding one of said controllers is in said disengaged mode.

7. A self regulating pool heater unit as recited in claim 6 wherein each of said controllers includes a single pole, double throw switch, and said engaged mode includes said switch in an open position and said disengaged mode includes said switch in a closed position.

8. A self regulating pool heater unit as recited in claim 7 wherein each of said single pole, double throw switches includes a third wire extending therefrom and connected with said corresponding indicator light.

9. A self regulating pool heater unit as recited in claim 6 wherein said controllers include at least one digital logic connection.

10. A self regulating pool heater unit as recited in claim 6 further including sampling means structured and disposed to direct power for a brief interval to said pool pump when said bypass switching means of said automatic timer bypass are in said bypass position such that a water thermostat of said refrigeration unit is able to determine if a temperature of the fluid being cycled is below a desired fluid temperature whereafter the power is maintained to said pool pump until the temperature of the fluid being cycled is sufficiently above said desired fluid temperature.

11. To be used with a pool assembly of the type including at least one pool pump, and at least a swimming pool and a spa, a self regulating pool heater unit comprising:

a power source, a refrigeration unit, said refrigeration unit being structured and disposed to emit heat so as to heat a quantity of fluid being cycled therethrough by said pool pump, said power source being structured and disposed to supply power to said refrigeration unit and said pool pump, a timer connected between said power source and at least said pool pump, said timer including an on mode wherein the power supplied by said power source flows therethrough to said pool pump and accordingly said pool pump functions to cycle the fluid through said refrigeration unit, and an off mode wherein no power flows therethrough to said pool pump, an automatic timer bypass connected in line between said power source and at least said pool pump, said automatic timer bypass including bypass switching means connected thereto and positionable between a bypass position and a normal position, said bypass position of said bypass switching means of said automatic timer bypass being defined by said power flowing therethrough to bypass said timer if said timer is not in said on mode, thereby ensuring that said power flows from said power source to at least said pool pump regardless of the mode of said timer so as to cycle said fluid through said refrigeration unit for heating thereof, and said normal position of said bypass switching means of said automatic timer bypass being defined by said power being capable of flowing from said power source to at least said pool pump only through said timer, thereby ensuring that only when said timer is in said on mode will said power flow to said pool pump.

12. A self regulating pool heater unit as recited in claim 11 wherein said automatic timer bypass is disposed in said refrigeration unit.

13. A self regulating pool heater unit as recited in claim 11 wherein said refrigeration unit further includes:

a water thermostat structured and disposed to periodically sample said quantity of fluid entering said refrigeration unit so as to determine its temperature, said water thermostat being adjustably set to detect a desired fluid temperature, a first controller connected with said water thermostat and including an engaged mode and a disengaged mode, said first controller being normally in said engaged mode while a fluid temperature detected by said water thermostat remains below said desired fluid temperature, and being in said disengaged mode while said fluid temperature detected by said water thermostat is at or above said desired fluid temperature, a water flow detector structured and disposed to determine a rate of fluid flow through said refrigeration unit, a second controller connected with said water flow detector and including an engaged mode and a disengaged mode, said second controller being normally in said engaged mode while the rate of fluid flow detected by said water flow detector is at or above a predetermined minimum water flow rate, and being in said disengaged mode while said rate of fluid flow detected by said water flow detector drops below said predetermined minimum water flow rate, an ambient temperature thermostat structured and disposed to measure a temperature of air being drawn into said refrigeration unit, a third controller connected with said ambient temperature thermostat and including an engaged mode and a disengaged mode, said third controller being normally in said engaged mode while the air temperature detected by said ambient temperature thermostat is at or above a predetermined minimum ambient air temperature, and being in said disengaged mode while said air temperature detected by said ambient temperature thermostat drops below said predetermined minimum ambient air temperature, a refrigerant pressure sensor structured and disposed to measure a pressure of a refrigerant contained for use by said refrigeration unit, a fourth controller connected with said refrigerant pressure sensor and including an engaged mode and a disengaged mode, said fourth controller being normally in said engaged mode while the refrigerant pressure detected by said refrigerant pressure sensor is at or above a predetermined minimum refrigerant pressure, and being in said disengaged mode while said refrigerant pressure detected by said refrigerant pressure sensor drops below said predetermined minimum refrigerant pressure, and a fifth controller connected with said refrigerant pressure sensor and including an engaged mode and a disengaged mode, said fifth controller being normally in said engaged mode while the refrigerant pressure detected by said refrigerant pressure sensor is at or below a predetermined maximum refrigerant pressure, and being in said disengaged mode when said refrigerant pressure detected by said refrigerant pressure sensor rises above said predetermined maximum refrigerant pressure, and said controllers being connected with said refrigeration unit such that only upon all of said controllers being in said normal engaged orientation will said refrigeration unit operate.

14. A self regulating pool heater unit as recited in claim 13 wherein each of said controllers is connected with a corresponding indicator light structured to remain off when a corresponding one of said controllers is in said engaged mode, and to turn on when said corresponding one of said controllers is in said disengaged mode.

15. A self regulating pool heater unit as recited in claim 13 further including mode switching means structured to switch said self regulating pool heater unit between a pool mode and a spa mode, said spa mode including activation of at least said pool pump regardless of said mode of said timer and said position of said bypass switching means of said automatic timer bypass, and said pool mode including activation of at least said pool pump only when said timer is in said on mode or when said bypass switching means of said automatic timer bypass are in said bypass position.

16. A self regulating pool heater unit as recited in claim 15 wherein said mode switching means and said automatic timer bypass are encoded in a digital circuit which incorporates a plurality of logic gates structured to permit the activation of at least said pool pump regardless of the mode of said timer only upon satisfaction of a plurality of predetermined conditions.

17. A self regulating pool heater unit as recited in claim 16 wherein said predetermined conditions include said mode switching means in said spa mode, or said mode switching means in said pool mode and said bypass switching means of said automatic timer bypass in said bypass position, and all of said controllers being in said engaged mode.

18. A self regulating pool heater unit as recited in claim 15 further including autovalve positioning means, said autovalve positioning means being structured to: automatically actuate a plurality of valves of the pool assembly so as to cycle the quantity of fluid only through the spa of the pool assembly when said mode switching means is moved to said spa mode; and automatically actuate the plurality of valves of the pool assembly so as to cycle the quantity of fluid through the swimming pool of the pool assembly.

19. A self regulating pool heater unit as recited in claim 11 further including mode switching means structured to switch said self regulating pool heater unit between a pool mode and a spa mode, said spa mode including activation of at least said pool pump regardless of said mode of said timer and said position of said bypass switching means of said automatic timer bypass, and said pool mode including activation of at least said pool pump only when said timer is in said on mode or when said bypass switching means of said automatic timer bypass are in said bypass position.

20. A self regulating pool heater unit as recited in claim 19 wherein said mode switching means and said automatic timer bypass are encoded in a digital circuit which incorporates a plurality of logic gates structured to permit the activation of at least said pool pump regardless of the mode of said timer only upon satisfaction of a plurality of predetermined conditions such as said mode switching means being in said spa mode, or said mode switching means being in said pool mode and said bypass switching means of said automatic timer bypass being in said bypass position.

21. A self regulating pool heater unit as recited in claim 19 further including autovalve positioning means, said autovalve positioning means being structured to: automatically actuate a plurality of valves of the pool assembly so as to cycle the quantity of fluid only through the spa of the pool assembly when said mode switching means is moved to said spa mode; and automatically actuate the plurality of valves of the pool assembly so as to cycle the quantity of fluid through the swimming pool of the pool assembly.

22. To be used with a pool assembly of the type including at least one pool pump, and at least a swimming pool and a spa, a self-regulating pool heater unit comprising:

a power source, a refrigeration unit, said refrigeration unit being structured and disposed to emit heat so as to heat a quantity of fluid being cycled therethrough by said pool pump, said power source being structured and disposed to supply power to said refrigeration unit and said at least one pool pump, a timer connected between said power source and at least said pool pump, said timer including an on mode wherein the power supplied by said power source flows therethrough to said pool pump and accordingly said pool pump functions to cycle the fluid through said refrigeration unit, and an off mode wherein no power flows therethrough to said pool pump, mode switching means structured to switch the self-regulating pool heater unit between a pool mode and a spa mode, autovalve positioning means structured and disposed to: automatically actuate a plurality of valves of the pool assembly so as to cycle the quantity of fluid only through the spa of the pool assembly when said mode switching means is moved to said spa mode, and automatically actuate the plurality of valves of the pool assembly so as to cycle the quantity of fluid through the swimming pool of the pool assembly, and an automatic timer bypass connected in-line between said power source and at least said pool pump.

23. A self-regulating pool heater unit as recited in claim 22 wherein said automatic timer bypass includes bypass switching means connected thereto and positionable between a bypass position and a normal position.

24. A self regulating pool heater unit as recited in claim 23 wherein said bypass position of said automatic timer bypass is defined by said power flowing therethrough to bypass said timer if said timer is not in said on mode, thereby ensuring that said power flows from said power source to at least said pool pump regardless of the mode of said timer so as to cycle said fluid through said refrigeration unit for heating thereof, and said normal position of said automatic timer bypass is defined by said power being capable of flowing from said power source to at least said pool pump only through said timer, thereby ensuring that only when said timer is in said on mode will said power flow to at least said pool pump.

25. A self regulating pool heater unit as recited in claim 24 wherein said spa mode of said mode switching means includes activation of at least said pool pump regardless of said mode of said timer and said position of said bypass switching means of said automatic timer bypass, and said pool mode includes activation of at least said pool pump only when said timer is in said on mode or when said bypass switching means of said automatic timer bypass are in said bypass position.

* * * * *